US009540798B2

(12) United States Patent
Chen et al.

(10) Patent No.: US 9,540,798 B2
(45) Date of Patent: Jan. 10, 2017

(54) DRAIN LOCK FOR A FLUSH VALVE RESERVOIR

(71) Applicant: FLUIDMASTER, INC., San Juan Capistrano, CA (US)

(72) Inventors: JunSheng Chen, Xiamen (CN); Joseph Han, Irvine, CA (US)

(73) Assignee: FLUIDMASTER, INC., San Juan Capistrano, CA (US)

( * ) Notice: Subject to any disclaimer, the term of this patent is extended or adjusted under 35 U.S.C. 154(b) by 298 days.

(21) Appl. No.: 14/480,298

(22) Filed: Sep. 8, 2014

(65) Prior Publication Data

US 2015/0067954 A1 Mar. 12, 2015

Related U.S. Application Data

(60) Provisional application No. 61/874,634, filed on Sep. 6, 2013.

(51) Int. Cl.

| | |
|---|---|
| ***E03D 5/02*** | (2006.01) |
| ***E03D 1/14*** | (2006.01) |
| ***E03D 1/35*** | (2006.01) |
| *E03D 1/22* | (2006.01) |

(52) U.S. Cl.

CPC ..... *E03D 1/144* (2013.01); *E03D 1/35* (2013.01); *E03D 1/22* (2013.01); *Y10T 29/49407* (2015.01)

(58) Field of Classification Search

CPC ..... E03D 1/14; E03D 1/34; E03D 1/35; E03D 1/142; E03D 1/144; E03D 5/00; E03D 5/02; E03D 1/22

USPC ..... 4/324, 340–342

See application file for complete search history.

(56) References Cited

U.S. PATENT DOCUMENTS

| | | | |
|---|---|---|---|
| 4,486,906 | A | 12/1984 | Meier |
| 5,956,781 | A | 9/1999 | Grant |

FOREIGN PATENT DOCUMENTS

| | | | |
|---|---|---|---|
| EP | 1 795 661 | A2 | 6/2007 |
| WO | WO 2006/058937 | A1 | 6/2006 |

OTHER PUBLICATIONS

PCT/ISA/US; International Search Report (PCT Article 18 and Rules 43 and 44) of PCT/US2014/054574; Nov. 23, 2014; pp. 1,2; PCT/ISA/US, Alexandria, Virginia.

*Primary Examiner* — J. Casimer Jacyna

(74) *Attorney, Agent, or Firm* — Gordon Rees Scully Mansukhani LLP; David R. Heckadon; Sean D. Flaherty

(57) ABSTRACT

An improved flush system as described herein may comprise a reservoir with a drain opening for egress of liquids disposed in the reservoir into a surrounding toilet tank. A lock mechanism is slidably received by the reservoir so that the lock mechanism is translatable between one or more fixed positions on the reservoir. In turn, translating the lock mechanism into the reservoir at increasing depths causes a size of the drain opening to be reduced and therefore adjusted.

14 Claims, 12 Drawing Sheets

DRAIN LOCK FOR A FLUSH VALVE RESERVOIR

CROSS-REFERENCE TO RELATED APPLICATIONS

This application claims priority to U.S. provisional patent application 61/874,634 entitled "Dual flush valve window lock" and filed Sep. 6, 2013, the contents of which are incorporated herein by reference in its entirety as if set forth verbatim.

FIELD

The present embodiments relate generally to toilet flush valves and particularly to refill for dual flush valves.

BACKGROUND

The present disclosure relates to toilet flush valves configured to impart multiple flush types (e.g. dual flush) from a toilet tank into a toilet bowl. For purposes of discussion, a toilet tank typically has a flush valve system that is forced opened and remains opened until a predetermined volume of liquid flows from the tank into the toilet bowl through the flush valve system. Liquid is supplied to the toilet tank through a fill valve from a liquid supply line to the toilet tank. In practice, the fill valve opens when the fluid level in the tank falls below a predetermined liquid level.

Flush valve assemblies typically include a flush valve, a float and an actuation mechanism. The actuation mechanism causes the flush valve to open and release liquids stored in tank into the toilet bowl and close when the float reaches a predetermined liquid level in the tank. For a dual flush valve, the toilet bowl may be refilled with liquids during the time the fill valve fills the toilet tank. The predetermined volume of liquid that refills the toilet bowl is sufficient to seal off the trap way of the bowl. In practice this predetermined volume amount may be defined as ratio of the total liquid volume supplied by the fill valve during a particular flush cycle. The fill valve feeds the liquids and feeds them to the tank bowl.

Toilets that can impart dual flushes have been found to be particularly advantageous in several situations. Specifically, prior to initiating a flush, a user may choose between a large flush water volume for solid waste (e.g. a full flush) or a smaller flush water volume for liquid waste (e.g. a partial flush). This may be done via a switch, button or the like on the actuation mechanism.

In general, dual flush valves (shown in FIG. 2) may be equipped with a flush volume controlling device associated with a flush volume, a drain opening lock, and full and partial flush control devices in order to maximize the volume of respective full and partial flushes. Full and partial flush control devices are typically adjustable to maximize respective flush volumes. Typically, a drain opening controls water inside of the reservoir that holds the full flush float. The size of the reservoir drain opening is controlled by the window lock that ultimately determines the full flush volume. In practice, OEM toilet manufacturers may preset the window lock position for their respective toilet models to comply with code such as watersense.

However, if the end user is able to alter the window lock setting, such alteration may violate the code due to the approved flush volume change. Accordingly, there is a need to resolve this problem so that end users are prevented from altering window lock settings.

SUMMARY

The following simplified summary is provided in order to disclose a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In certain dual flush valve assemblies, dual flush canister valves may be used and said valves typically comprise a bottom reservoir that comprises a flush float therein. The reservoir may also have a side drain window or drain opening that permits water to drain therethrough into the tank. The actual flush volume used in a given system corresponds to the amount the size of drain opening since having the drain open permits relatively more water to drain out of the reservoir thereby decreasing the associated flush volume.

In practice, toilet manufacturers commonly set the window open to different flush volumes so they can optimize a respective predetermined flush volume for use in their respective toilet design. The present disclosure provides a lock mechanism that maintains the drain opening in a fixed position to permit a predetermined amount of water associated with a respective design and prevents the drain opening size from being adjusted.

In some embodiments, the lock mechanism is slidably inserted into at least one rail formed in the reservoir body. The lock mechanism may comprise teeth or tabs designed to lockably engage grooves in the at least one rail. In other embodiments, the tabs may extend from a locking arm. Each tab is designed to prevent adjustment of the drain opening by preventing movement of the lock mechanism along the grooves in the at least one rail.

In other embodiments, a flush valve system as disclosed herein comprises a reservoir and a lock mechanism. The reservoir comprises a drain opening for egress of liquids disposed in the reservoir into a surrounding toilet tank. The lock mechanism is slidably received by the reservoir, wherein the lock mechanism is translatable between one or more fixed positions on the reservoir. Translating the lock mechanism into the reservoir at increasing depths causes a size of the drain opening to be adjust and thus reduced.

In a pre-flush state, the reservoir may comprise liquids so that during a flush, the liquids drain out of the reservoir through the drain opening. A receiver may be coupled to the reservoir adjacent to the drain opening so that the receiver being coupled to the reservoir slidably receives the lock mechanism. In this embodiment, one or more bias arms may extend substantially parallel or longitudinally along one or more outer edges of the lock mechanism, wherein each bias arm may comprise an inwardly or outwardly facing projection and one of the bias arms may comprise a locking tab. A detent arm may be substantially parallel to one of the bias arms and designed to receive the locking tab.

Accordingly, the receiver may further comprise one or more grooves associated with the one or more bias arms and designed to slidably receive the projections of the bias arms between the one or more fixed positions. As such, the lock mechanism may be locked in one of the fixed positions when the detent arm receives the locking tab.

In other embodiments, the one or more grooves may further comprise one or more notches or teeth to receive the projections of the bias arms as the lock mechanism is slidably received by the receiver between one or more fixed positions. This is particularly advantageous since it allows the preferred or required drain opening size to be pre-set based upon the one or more fixed positions. Further, a beveled edge may be positioned on each projection causing the associated bias arm to flex inwardly or outwardly as the beveled edge slides over associated notches or teeth.

In other embodiments, a reinforcement lock with a plurality of locking arms may be received by the lock mechanism to reinforce and thus maintain the lock mechanism in the one or more fixed positions. The reinforcement lock accomplishes this by inserting the locking arms between the bias arms of the lock mechanism and the central portion of the lock mechanism thereby providing a secure coupling between the reinforcement lock and the reservoir. The reinforcement lock may optionally comprise a locking member that extends into the lock mechanism when the locking arms are inserted between the bias arms to fix the lock mechanism in one of the fixed positions. The locking member may be integrally formed with the reinforcement lock or removably attached thereto.

In other embodiments, the detent arm may further comprise a tab receiving surface so that the detent arm may be flexed or moved until the tab receiving surface is coupled to the locking tab to lock the lock mechanism in position. Each bias arm and detent arm may therefore be flexible and designed so that when flexed, they have the tendency to return to their pre-flexed position.

Alternatively, the lock mechanism may further comprise two or more bias arms that extend longitudinally along one or more edges of the lock mechanism. Each bias arm may be disposed on an opposite edge of the lock mechanism and may comprise an outwardly facing projection and a coupling surface. The receiver in this embodiment may further comprises one or more grooves associated with the one or more bias arms to slidably receive the projections of the bias arms between the one or more fixed positions. As such, the coupling surfaces may move or flex until contacting each other to couple and thus lock the lock mechanism in one of the fixed positions.

Preferably, the disclosed system is configured to be utilized with a drain opening that is approximately 0.15 inches, 0.3 inches, 0.35 inches and/or 0.6 inches.

In other embodiments, a method is provided to adjust a drain opening in a reservoir of a flush valve system in a toilet tank. The method comprises the steps of: slidably inserting a lock mechanism into a receiver coupled to the reservoir, wherein the drain opening governs egress of liquids disposed in the reservoir into the surrounding tank; translating the lock mechanism between one or more fixed positions on the receiver by slidably inserting one or more bias arms of the lock mechanism into one or more grooves of the receiver, and wherein translating the lock mechanism at increasing depths into the receiver causes a size of the drain opening of the reservoir to be adjusted; fixing the locking mechanism in one of the one or more fixed positions by coupling a detent arm of the lock mechanism with one of the bias arms.

The lock mechanism may further comprise one or more bias arms with projections facing inwardly or outwardly relative to the receiver. The one or more grooves may comprise one or more notches or teeth to receive the projections of the bias arms of the lock mechanism so that the method further comprises maintaining the lock mechanism in one of the one or more fixed positions by coupling each projection with an associated notch or tooth.

In some embodiments, the method includes flexing the one or more bias arms outwardly or inwardly causing the projection to couple with an associated notch or tooth. The method may further comprise reinforcing the lock mechanism in the one or more fixed positions by removably attaching a reinforcement lock onto the lock mechanism; and slidably inserting arms of the reinforcement lock between the bias arms of the lock mechanism to removably couple the reinforcement lock to the lock mechanism and the receiver.

In another embodiment, a similar method is provided, comprising: slidably inserting a lock mechanism into a receiver coupled to the reservoir, wherein the drain opening governs egress of liquids disposed in the reservoir into the surrounding tank; translating the lock mechanism between one or more fixed positions on the receiver by slidably inserting two or more bias arms of the lock mechanism into one or more grooves of the receiver, each bias arm comprising a coupling surface positioned on a respective distal end, and wherein translating the lock mechanism at increasing depths into the receiver causes a size of the drain opening of the reservoir to be adjusted; fixing the locking mechanism in one of the one or more fixed positions by coupling together the coupling surface of each bias arms.

The disclosed embodiments are particularly advantageous since it provides a locking feature that prevents factory float settings from being manipulated by an end user or the like. To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

At the same time, various elements of the device described herein may be slightly altered for various different features and various different or altered uses thereof, and these predicated changes and alterations are fully contemplated within the principles of the present disclosed improvements.

BRIEF DESCRIPTION OF THE DRAWINGS

FIGS. 3A and 3B depict perspective views of one embodiment of a lock mechanism and a reservoir, wherein FIG. 3A depicts the lock mechanism and the reservoir in an exploded state prior to being assembled and FIG. 3B depicts each component once assembled.

FIGS. 6A and 6B depict another exemplary embodiment of a lock mechanism and corresponding reservoir, wherein FIG. 6A depicts the lock mechanism and the reservoir in an exploded state prior to being assembled and FIG. 6B depicts each component once assembled.

DETAILED DESCRIPTION

The device of the present disclosure may be economically molded by using one or more distinct parts to form the features and mechanisms disclosed herein which, when assembled together in an economical fashion, may form the device regardless of the particular form. Unless defined otherwise, all terms of art, notations and other scientific terms or terminology used herein have the same meaning as is commonly understood by one of ordinary skill in the art to which this invention belongs.

In some cases, terms with commonly understood meanings are defined herein for clarity and/or for ready reference, and the inclusion of such definitions herein should not necessarily be construed to represent a substantial difference over what is generally understood in the art. All patents, applications, published applications and other publications referred to herein are incorporated by reference in their entirety. If a definition set forth in this section is contrary to or otherwise inconsistent with a definition set forth in the patents, applications, published applications and other publications that are herein incorporated by reference, the definition set forth in this section prevails over the definition that is incorporated herein by reference.

As used herein, "a" or "an" means "at least one" or "one or more."

As used herein, the term "user", "subject", "end-user" or the like is not limited to a specific entity or person. For example, the term "user" may refer to a person who uses the systems and methods described herein, and frequently may be a field technician. However, this term is not limited to end users or technicians and thus encompasses a variety of persons who can use the disclosed systems and methods.

Figure 1:
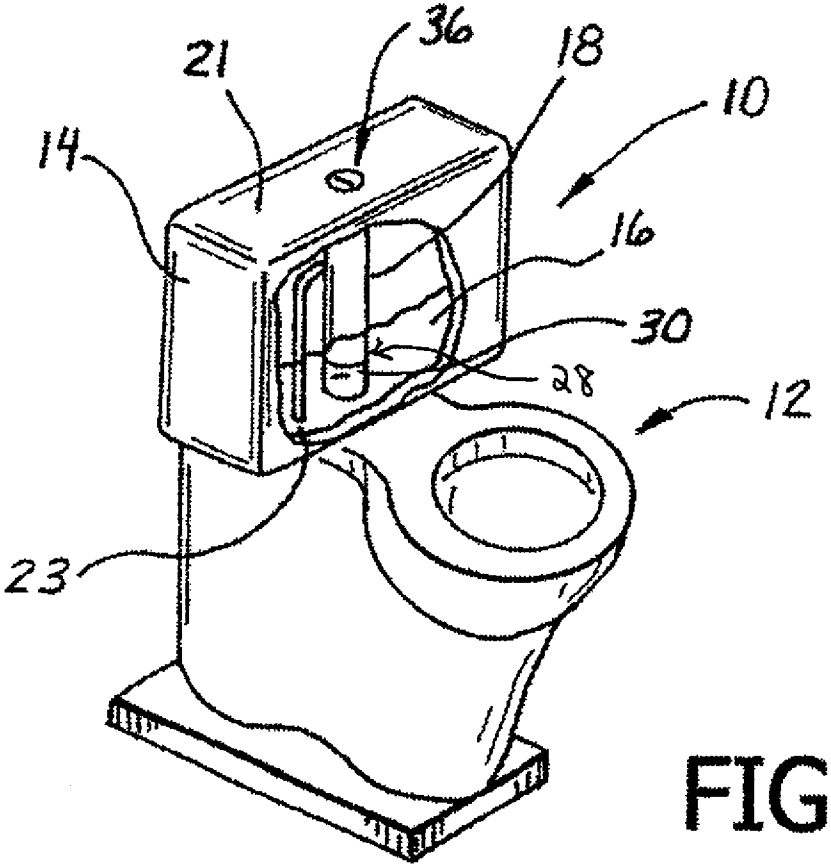
FIG. 1 is a perspective view of a toilet partially in phantom to illustrate a flush valve system of the present disclosure when installed in a toilet tank.

FIG. 1 depicts a conventional toilet 10 with a bowl 12 that receives liquid and solid waste. A toilet tank 14 is typically positioned above bowl 12 and comprises flush valve reservoir 28 for liquid 16 (e.g. water) that is used to flush bowl 12. A flush valve system 18 is seen operatively coupled between an upper 21 and lower 23 portion of tank 14.

Figure 2:
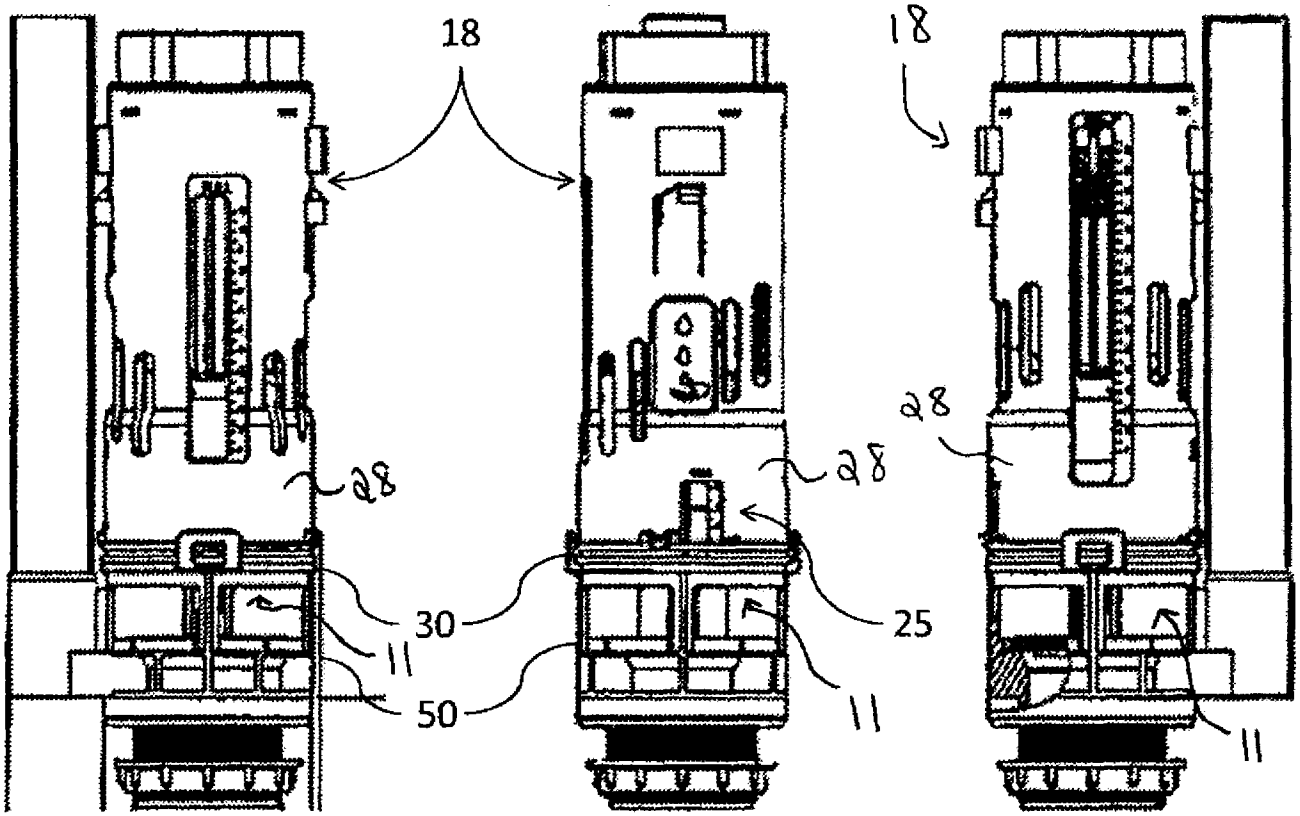
FIG. 2 is an illustration of an exemplary flush valve system showing the position of a drain opening of a reservoir associated with the flush valve system.

FIG. 2 depicts several perspective views showing the different sides of the same embodiment of system 18 comprising reservoir 28 with window 25. In practice, canister valves such as those in system 18 typically comprise said reservoir 28 with float 11. Reservoir 28 may have a closed lower surface with circumferential walls extending upwards and an open upper surface. In turn, float 11 may be designed with a closed upper surface and circumferential walls that extend downwards towards the closed lower surface of reservoir 28, wherein float 11 is designed to be inserted into or received by reservoir 28.

Window 25 permits water in reservoir 28 to drain out into tank 14 and bowl 12 if the flush valve is in an open position. The volume of water associated with the flush used by system 18 corresponds to the amount of water that window 25 permits to flow (e.g. the size of the opening imparted by window 25) since the size of window's 25 opening directly affects that whether window 25 permits relatively more water to drain out of reservoir 28 thereby decreasing the associated flush volume.

Figure 3B:
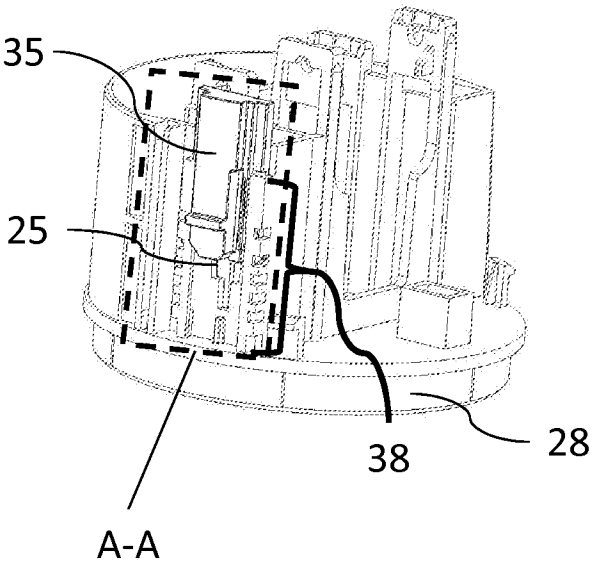
Figure 3A:
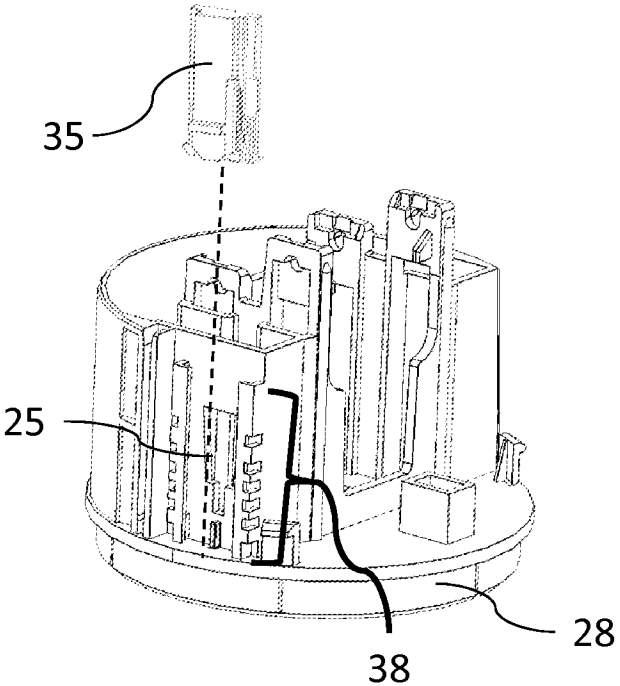

It can be seen in FIG. 2 that window 25 may be disposed in the lower portion 30 of system 18 adjacent to column 50. Window 25 may further comprise certain locking features such as teeth, tabs, grooves, or the like as described more particularly below. Because window 25 functions as an adjustable drain hole associated with the predetermined flush volume associated with system 18 when installed in toilet 11, window lock mechanism 35 of FIGS. 3*a* and 3*b* is provided to interact with window 25 in order to resolve the problem of end users altering the certain lock settings (e.g. the opening size) of window 25 and corresponding locking features. Lock mechanism 35 may only control the flush volume associated with reservoir 28 and float 11 when float 11 is positioned inside of reservoir 28.

Accordingly, FIG. 3*a* depicts a perspective view of reservoir 28 and window lock mechanism 35 in an exploded state, wherein mechanism 35 is seen prior to being received by reservoir 28. FIG. 3*b* depicts a perspective view of reservoir 28 and associated mechanism 35 after mechanism has been slidably received by reservoir 28. Reservoir 28 comprises window locking mechanism receiver 38 configured to slidably receive mechanism 35 (as described in detail below). Receiver 38 may comprise one or more rails or edges 40 that are positioned adjacent to the outer circumferential wall of reservoir 28 and in communication with window 25. Accordingly, when receiver 38 receives mechanism 35 at increasing depths, mechanism 35 functions to adjust the size of the opening in window 25 that allows egress of fluids from reservoir 28 into tank 14 thereby regulating the amount of water permitted to flow out from reservoir 28 through window 25. As such, locking features of mechanism 35 such as latches, teeth, tabs, protrusions of the like (hereinafter "latch") may engage grooves or edges 40 of receiver 38 to adjust the drain hole opening size of window 25. Once the desired drain opening size is obtained and edges 40 of receiver have engaged mechanism 35, lever arm 47 of locks or rigidly positions mechanism 35 in position so that the end-user or the like is incapable of adjusting the drain opening size.

Receiver 38 may be integrally formed with reservoir 28 or may removably attached thereto so that receiver 38 is positioned adjacent and external to window 25. In FIG. 3*b*, mechanism 35 is depicted slidably received by receiver 38 of reservoir 28 at a predetermined depth in receiver 38. In other words, mechanism 35 has been received by receiver 38 until being fixed in position at notch 42 which corresponds to a predetermined amount of water flowing from reservoir 28 into tank 14. If the amount of water flowing through window 25 needs to be reduced, mechanism 35 simply slides downwards towards additional notches 42 at increasing depths in receiver 38. As can be seen, mechanism 35 is capable of engaging with receiver 38 in one or more fixed relationships through notches 42, rails and/or grooves of the one or more edges 40 of receiver 38 as described more particularly in FIG. 5.

Figure 4B:
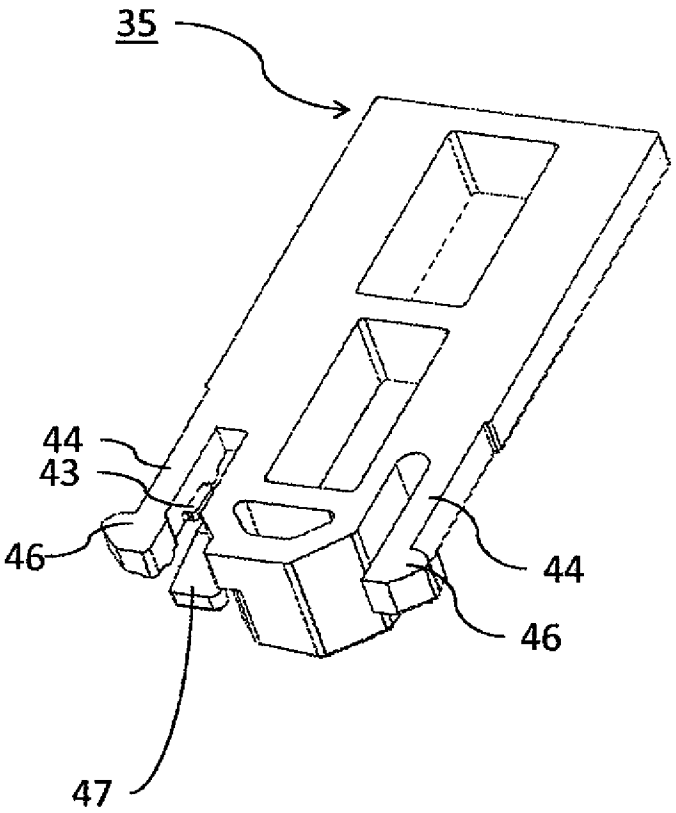
FIGS. 4A, 4B, 4C, and 4D depict related close-up perspective views of the lock mechanism of FIG. 3.
Figure 4A:
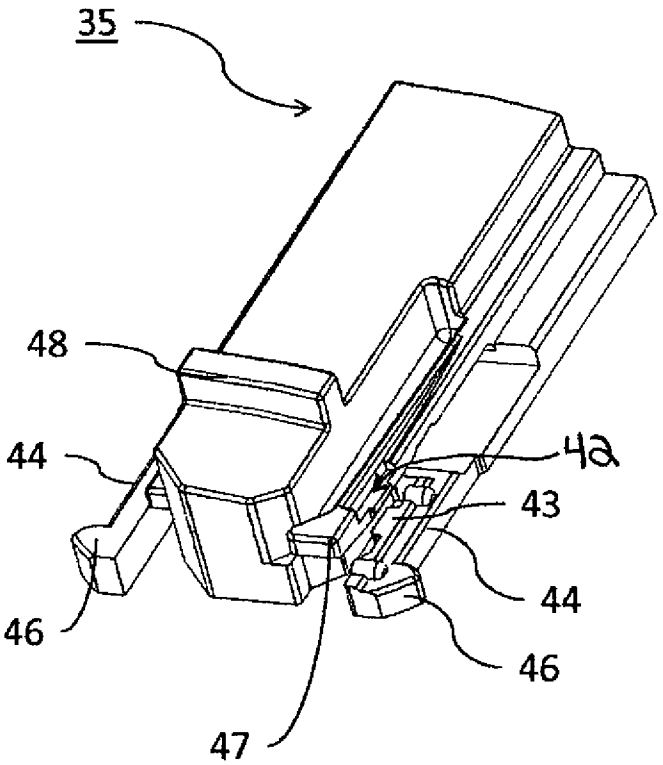

FIGS. 4A through 4D depict related close-up perspective views of mechanism 35 between a freely positionable state and a locked state. It is understand that freely positionable signifies that the mechanism 35 is slidably adjustable in receiver 38 and locked state means that the mechanism is fixed in position on the receiver. More particularly, FIG. 4*a* illustrates the forward face of mechanism 35 facing upwards. When mechanism 35 is slidably coupled to receiver 38, said forward face of mechanism 35 is pointed away from reservoir 28. By contrast, FIG. 4*b* illustrates a perspective view of mechanism with its aft face facing upwards, wherein when mechanism 35 is slidably coupled to receiver 38, said aft face is facing towards and seated adjacent to circumferential walls of reservoir 28 and window 25.

Mechanism 35 comprises receiver coupling portions 44 disposed on the lower, distal end of mechanism 35, wherein the proximal end of mechanism 35 is positioned on the upper end of mechanism 35. As can be seen, portions 44 may comprise a U- or C-shaped curved section that guides portion 44 into respective edge 40 (See FIG. 5). Portion 44 may be a locking arm that extends downward from a middle section of mechanism 35 toward the distal end, wherein portion 44 then extends laterally away from mechanism 35 to form latch 46. Accordingly, latch 46 is outwardly facing with respect to portion 44.

In this respect, the one or more notches 42 on each of edges 40 are configured to receive respective locking portion 44 and associated latch 46 of mechanism 35. Edges 40 facilitate the described sliding, telescoping relationship between receiver 38 and mechanism 35. As the beveled edge of latch 46 is guided past associated notch 42 of edge 40 (described below) and mechanism 35 slides into receiver 38, portion 44 flexes inwardly while maintaining a bias force that causes portion to bias outwards when latch 46 communicates with the subsequent notch 42.

Figure 4D:
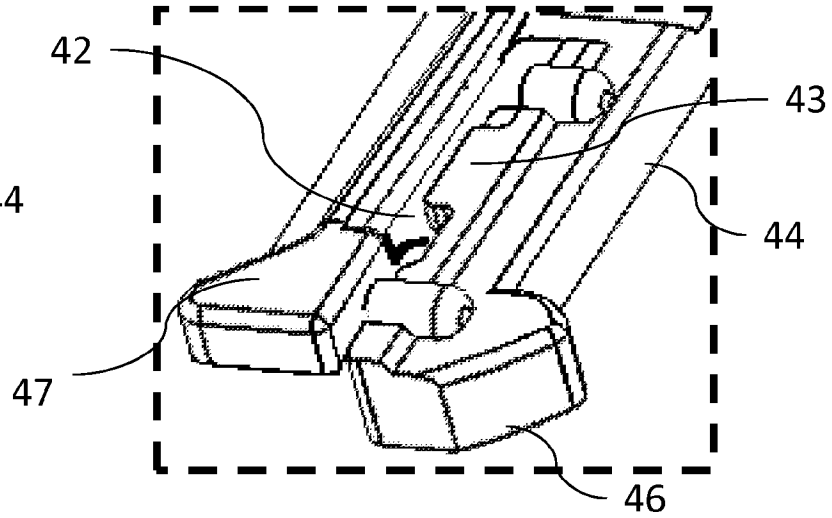

When a desired height of mechanism 35 is achieved to permit the predetermined amount of fluids to egress from reservoir 28 into tank 14, mechanism 35 further comprises at least one detent arm 47 to fix or rigidly attach mechanism 35 in place on receiver 38 in the locked state. Particularly, FIGS. 4C and 4D depict close-up perspective views of arm 47 moving between the freely positionable state (FIG. 4C) and then locking, fixing, or otherwise detaining mechanism 35 in place on receiver 38 once the predetermined height has been achieved (FIG. 4D).

Figure 4C:
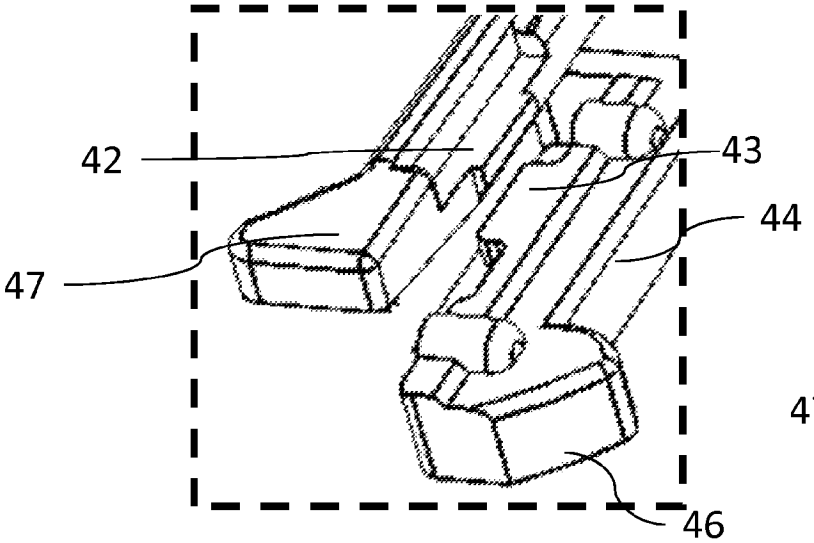

As can be seen, arm 47 may be substantially parallel with portion 44, wherein in the freely positionable state of FIG. 4C is disposed slightly above or away from portion 44. Arm 47 may be relatively flexible with a bias force so that when arm 47 is moved or flexed, arm 47 tends to bias back towards its initial pre-flex position. Portion 44 further comprises locking tab 43 and arm 47 further comprises corresponding locking tab receiving surface of notch 42. In this respect, once portion 44 and latch 46 have arranged or positioned mechanism 35 in its desired notch 42 so that the desired flow through window 25 is positioned, arm 47 is flexed towards portion 44 until the surface of notch 42 is underneath or otherwise coupled to tab 43. Once tab 43 and notch 42 are coupled, mechanism 35 is fixed in position since it is now incapable of sliding along receiver 38 so that the drain opening size is set. Notch 42 may comprise a flange or shoulder that extends away from arm 47 so that when positioned underneath portion 44, the corresponding tab 43 of portion 44 is caused to contact and retain the surface of notch 42 in place.

Notch 42 may be positioned in the locked state by applying a force substantially normal to notch 42 using a tool or the like until surface is coupled to tab 43. Optionally, mechanism 35 may comprise handle 48 onto which the end-user can grasp and slide mechanism 35 into receiver 38 and drive mechanism 35 between positions between notches 42 as desired or needed.

Figure 5:
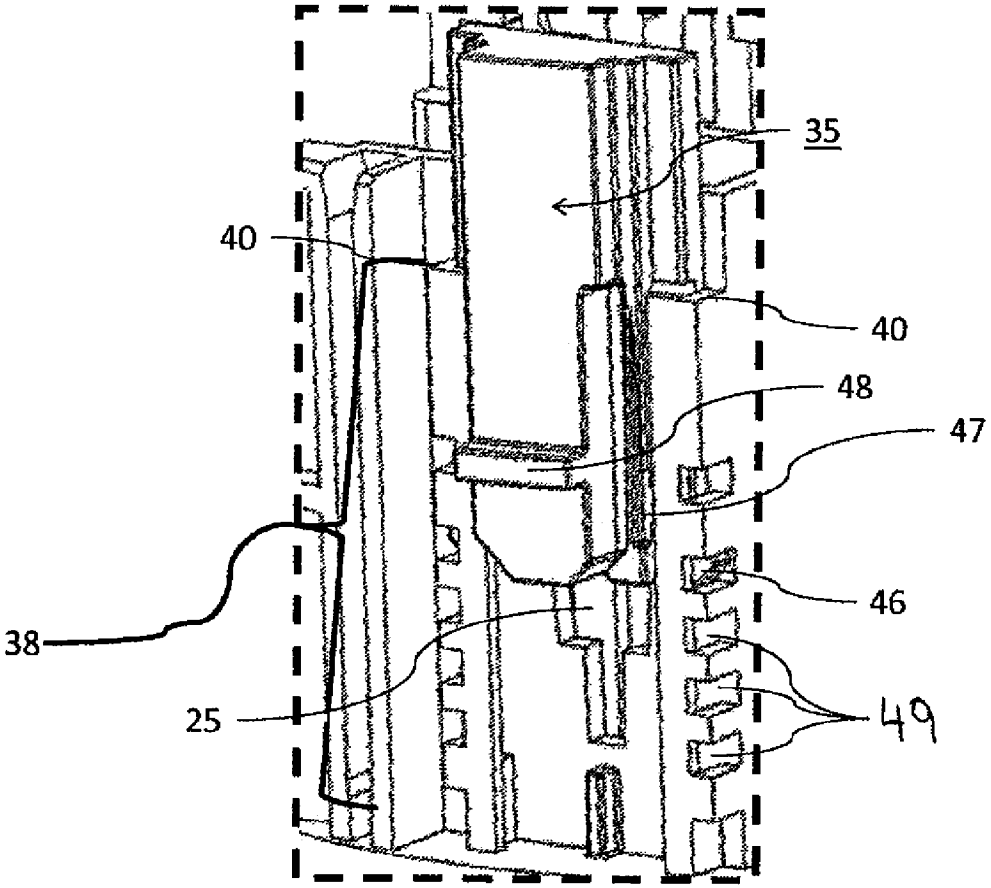
FIG. 5 depicts a close-up view of section A-A from FIG. 3B.

More particularly, FIG. 5 depicts a close-up of section A-A from FIG. 3*b* wherein receiver 38 has slidably received mechanism 35. It can be seen that each portion 44 has been slidably received by edge 40, wherein the bias force created by portion 44 causes latch 46 to bias towards notches 49 of receiver 38. In FIG. 5, latch 46 is seen positioned in the second highest notch 49 of receiver 38. However, mechanism 35 may be slid between fixed positions on receiver 38 by depressing portions 44 inwards until a preferred or required opening of window 25 is achieved wherein portions 44 are then released so that the natural bias of portions 44 causes latch 46 to insert into notch 49 and position or place the opening of window 25.

Figure 6B:
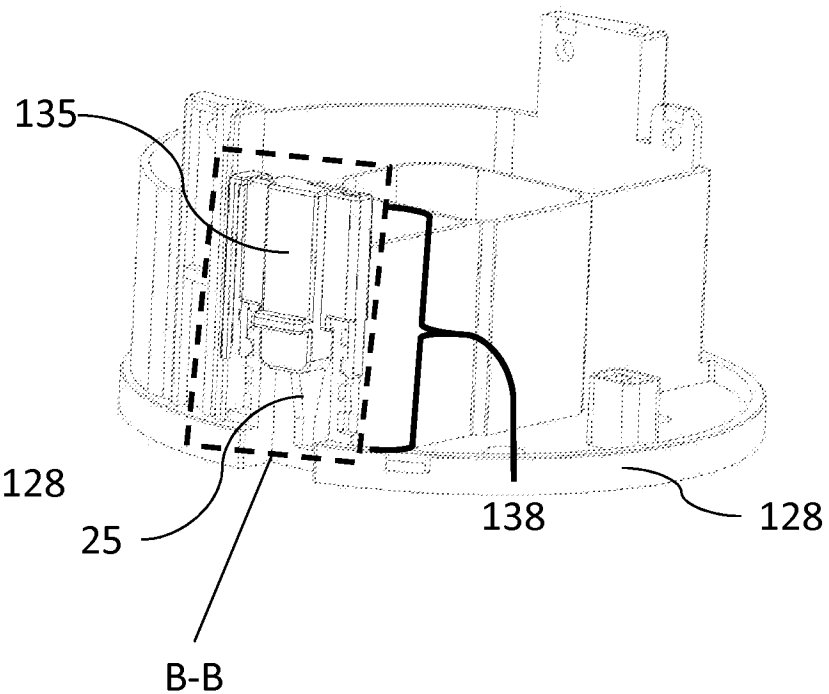
Figure 6A:
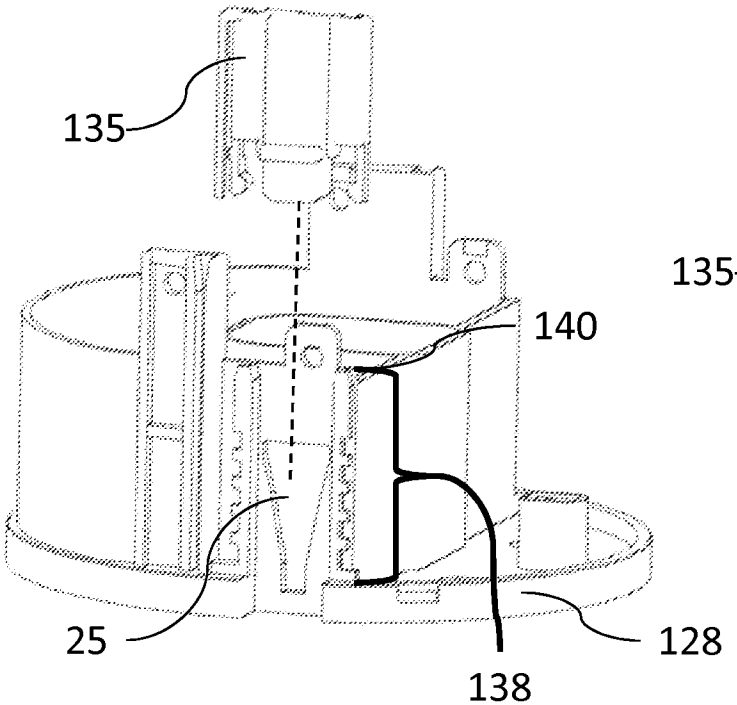

FIGS. 6*a* and 6*b* depict another embodiment of a locking mechanism 135 and reservoir 128 that are installable in toilet 10. Similar to the previously described embodiments, reservoir 128 comprises a window 25 through which water flows between reservoir 128 and tank 14 under certain conditions. Specifically, FIG. 6*a* depicts a perspective view of reservoir 128 and window lock mechanism 135 in an exploded state, wherein mechanism 135 has not yet been assembled with reservoir 128. Similar to previously described embodiments, in order to receive mechanism 135, reservoir 128 comprises window locking mechanism receiver 138 to receive mechanism 135. Accordingly, FIG. 6*b* depicts a perspective view of reservoir 128 when the associated window lock mechanism 135 has been slidably received by receiver 138 of reservoir 128. As can be seen, receiver 138 may comprise one or more rails or edges 140 positioned adjacent to the outer circumferential wall of reservoir 128 and in communication with window 25. When receiver 138 receives mechanism 135 at increasing depths, increasing the depth of mechanism 135 in receiver 138 adjusts the size of the fluid opening of window 25 thereby regulating the amount of water permitted to flow from reservoir 128 through window 25.

Figure 8:
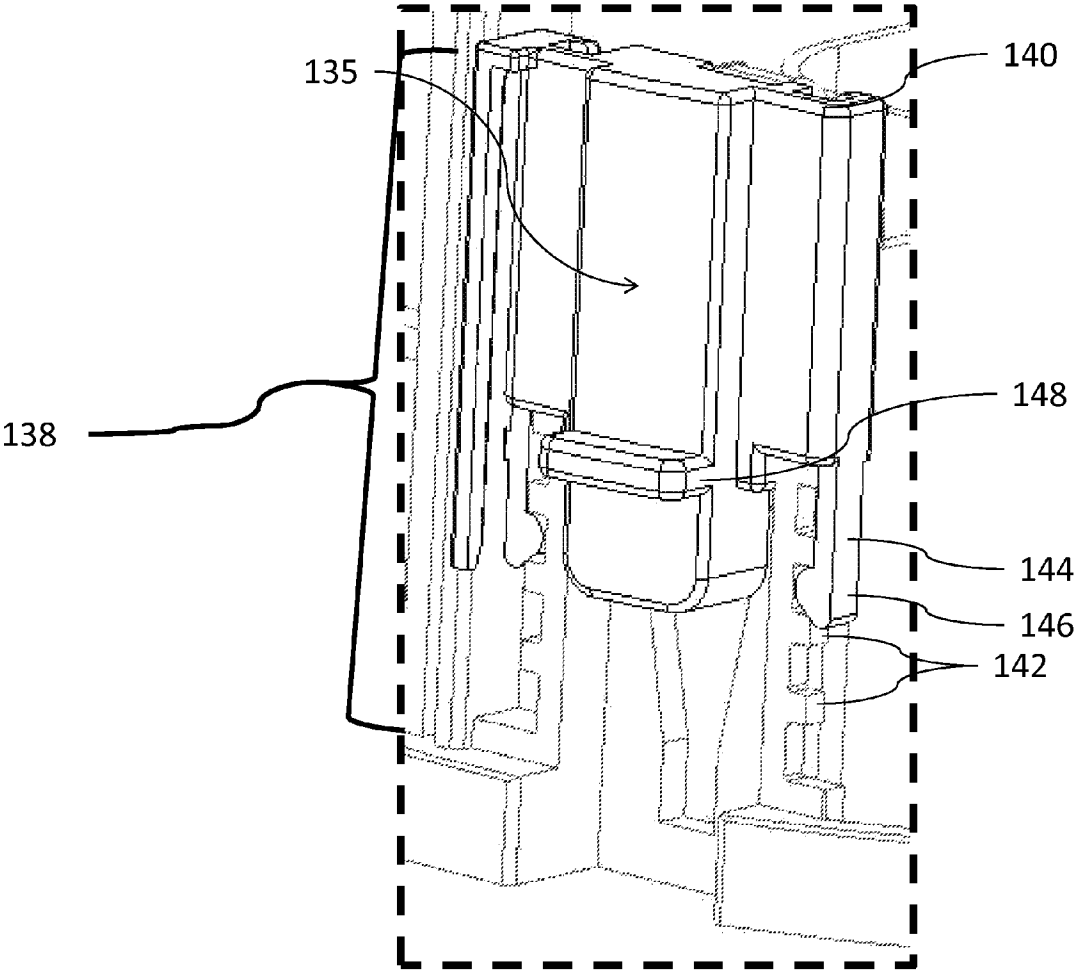
FIG. 8 depicts a close-up view of section B-B from FIG. 6B.

As in other embodiments, receiver 138 may be integrally formed with reservoir 28 or designed to removably attach thereto. In all embodiments, receiver 138 is positioned adjacent and external to window 25. In FIG. 6*b*, mechanism 135 is depicted after having been received by receiver 138 of reservoir 128. As can be seen, mechanism 135 is configured to be completely removed from receiver 138 and be removably attached in one or more fixed positions with teeth 142, rails or grooves of the one or more edges 140 of receiver 138 as described more particularly in FIG. 8. It is understood that teeth 142 may be any portion or member of edge 140 that extrudes away from window 25 in any orientation, thickness, pattern or depth sufficient to receiver latch 146 of portion 144 of mechanism 135 in order to rigidly connect mechanism 135 in place at a desired position. Accordingly, latch 146 is inwardly facing with respect to portion 144.

Figure 7A:
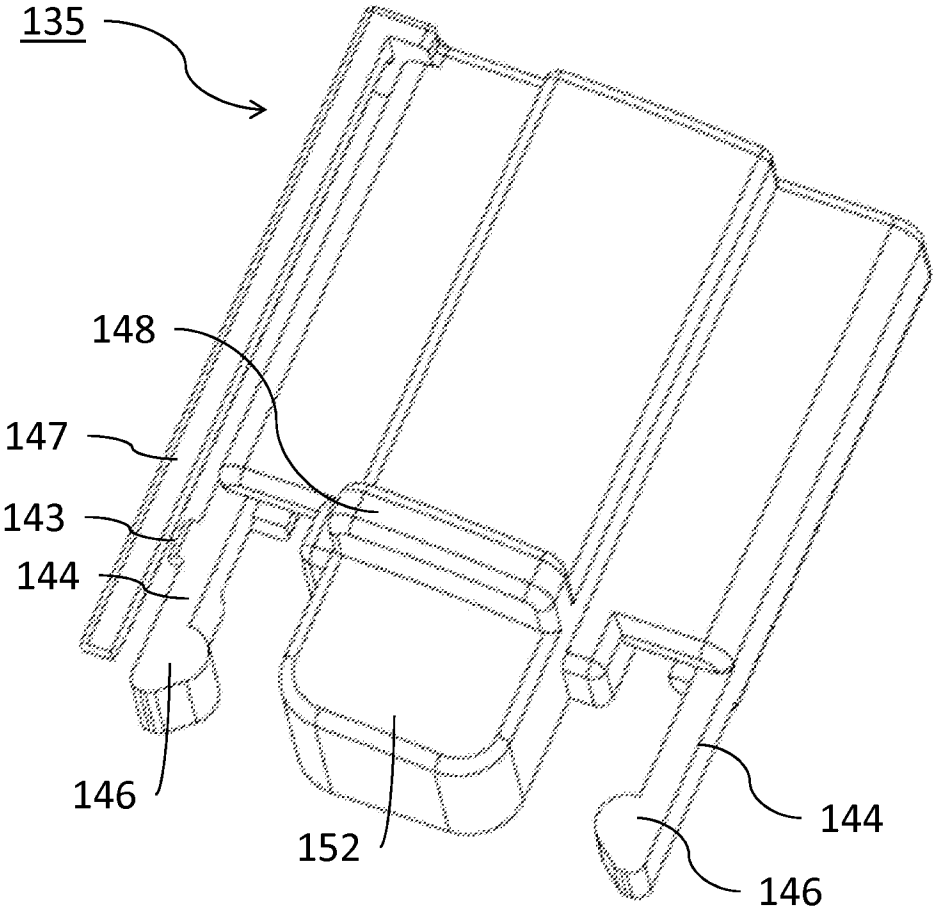
FIGS. 7A and 7B depict perspective views of the lock mechanism of FIG. 6 in between freely positionable and fixed states.
Figure 7B:
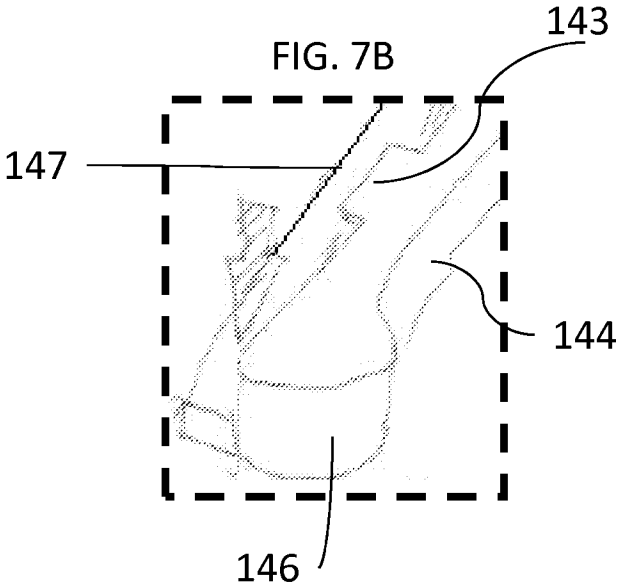

FIGS. 7A and 7B depict perspective, close-up views of the forward face of mechanism 135 when facing upwards, wherein the forward face when coupled to receiver 138 faces away from reservoir 128. Specifically, FIG. 7A depicts mechanism 135 in a freely positionable state and FIG. 7B depicts a close up of mechanism 135 in a locked state. As can be seen, mechanism 135 similarly comprises locking portions 144 disposed on the lower, distal end of mechanism 135 so that the proximal end of mechanism 135 is positioned along the upper portion of mechanism 135. Portions 144 are configured to be positioned external to corresponding edges 140 of receiver 138. In this respect, a space is provided between the center portion 152 of mechanism 135 and portion 144. When mechanism 135 is slidable inserted into receiver 138 by passing over edges 140, the space causes portion 144 and edge 140 to communicate and accurately guide mechanism 135 into the receiver 138.

Portion 144 therefore extends downward from a middle section (positioned between the distal and proximal ends) of mechanism 135 towards the distal end with latch 146 positioned on its tip. Latch 146 extends laterally towards mechanism 135 and comprises a beveled edge configured to guide insertion of portions 144 to pass over teeth 142 of receiver 138. Portion 144 is configured to flex outwardly so that as mechanism 135 slides over a corresponding tooth 142, the beveled edged of latch 146 causes portion to flex 144 away from portion 152. Portion 144 further comprises a bias that causes portion 144 to bias latch 146 towards tooth 142 as mechanism 135 slidably moves between teeth 142 (and thus fixed positions). When a desired height of window 25 is achieved by sliding mechanism 135 between fixed positions on receiver 138, portion 144 positions latch 146 of mechanism 135 in place on receiver 138 and at least one detent arm 147 then fixes or rigidly attaches mechanism 135 in position in the aforementioned locked state. Particularly, FIG. 7B depicts close-up perspective view of arm 147 after having moved from the freely positionable state (FIG. 7A) to then detaining mechanism 135 in place (FIG. 7B).

As can be seen, arm 147 may be substantially parallel with portion 144, wherein in the freely positionable state of FIG. 7A is disposed slightly above or away from portion 144. Arm 147 may be relatively flexible with a bias force so that when arm 147 is moved or flexed, arm 147 tends to bias back towards its initial pre-flex position. Portion 144 further comprises locking tab 143. In this respect, once portion 144 and latch 146 have arranged or positioned mechanism 135 in its desired tooth 142 so that the desired flow through window 25 is set, arm 147 is flexed towards portion 144 until it is underneath or otherwise coupled to tab 143. Once tab 143 and arm 147 are coupled, mechanism 135 is fixed in position, incapable of sliding, so that the drain opening size is set.

Arm 147 may be positioned in the locked state by applying a force substantially normal with respect to receiver 38 using a tool or the like (see arrow of FIG. 7B) until arm 147 has flexed and/or is coupled to tab 143.

In any of the previously described embodiments, when portions 44 or 144 are disposed between respective edges 40/140 and reservoir 28/128, latches 46/146 are incapable of being disengaged.

Figure 9:
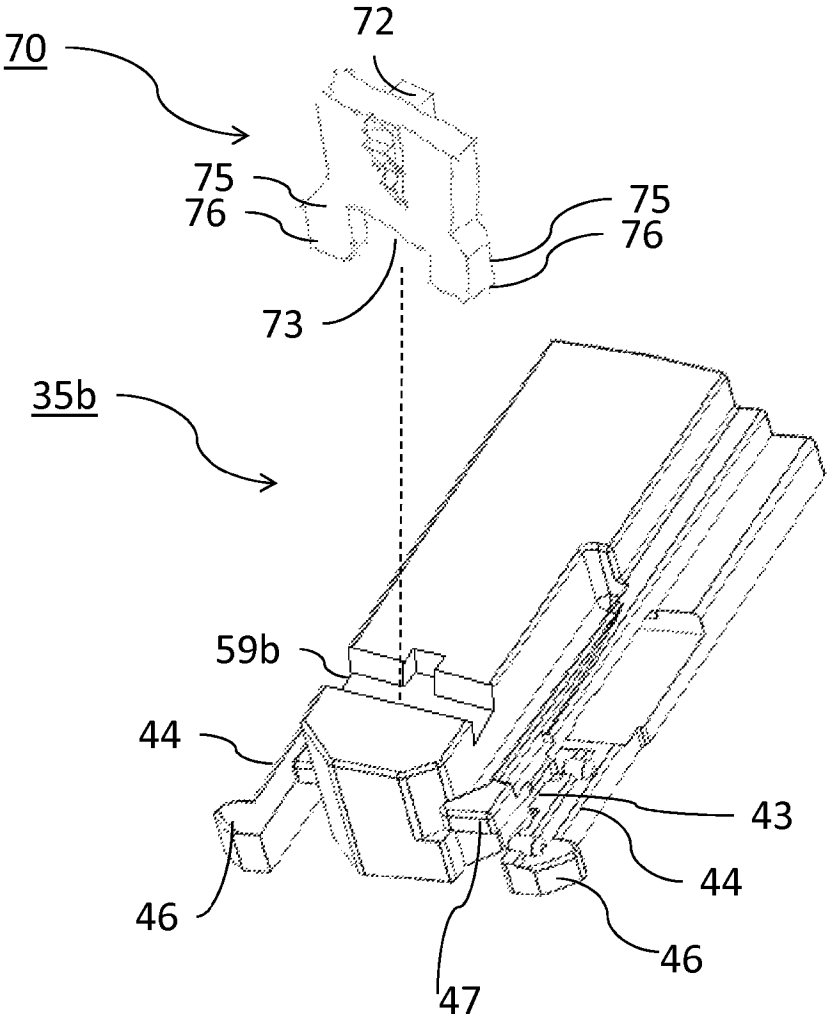
FIG. 9 depicts an exploded view of another exemplary embodiment of a lock mechanism when coupled with a reinforcement lock.

Optionally, FIG. 9 depicts any of the previously described mechanisms 35 or 135 in an exploded state with a positive lock 70. As explained, lock 70 is intended to be inserted onto mechanisms 35/135 after either have been coupled to receivers 38/138 to further prevent unexpected disengagement or adjustment of the drain hole opening associated with window 25. As such, lock 70 provides a second layer to ensure that mechanism 35 or 135 remains securely fastened in the predetermined position on associated receiver 38 or 138. Because mechanisms 35/135 may modified slightly to receive lock 70, mechanism in FIG. 9 is referred to as 35*b* since portions of mechanism 35 have been recessed in order to receive lock 70. In this respect, lock 70 comprises spine 72 and receiving portion 73 configured to be insertably mounted onto mechanism 35*b*. Latches 76 of lock 70 are configured to extend from lock arms 75 around center portion 52*b* of mechanism 35*b* until contacting receiver 38 to engage mechanism 35*b* to the same. Therefore, latches 76 may be designed to lockingly engage with any of the notches 42, teeth 142 or the like so that lock 70 fixes mechanism 35*b* in the position needed or desired. In this respect, if latches 46 of mechanism 35*b* fail or slip out of position once engaged with corresponding notches 42/teeth 142, then lock 70 serves to ensure that mechanism 35*b* will not disengage from the predetermined position corresponding to notch 42 thereby ensuring that the drain hole opening associated with window 25 is maintained as required by code.

Figure 10:
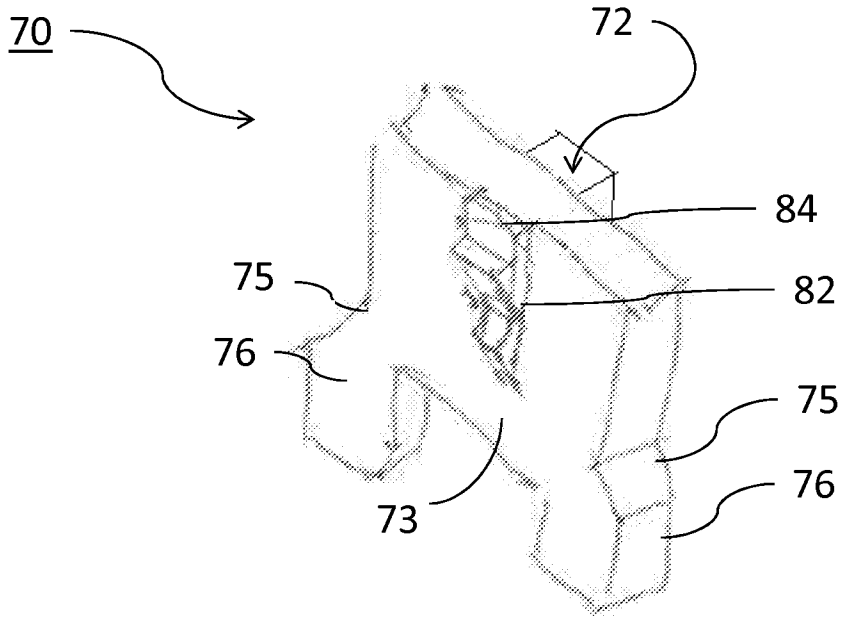
FIG. 10 depicts a close-up perspective view of the reinforcement lock of FIG. 9.

As seen in FIG. 10 in a close up view of the lock 70 of FIG. 9, lock further comprises first 82 and second 84 positioning members that extend away from lock 70 opposite spine portion 72 and towards corresponding center portion 52*b* of mechanism 35*b*. First positioning member 82 is a slightly slanted surface (e.g. not a substantially flat or planar latch surface) that extends away from lock 70 which is a first stopping surface using for adjusting lock 70. Second positioning member 84 is configured to further lock or detain mechanism 35*b* in place once the desired drain opening size is obtained similar to the purpose of arm 47. Member 84 may similarly extend away from lock 70 in the same direction as member 82 but is instead substantially parallel with the upper surface of lock 70 (e.g. substantially flat or flat) so that locks, couples, snaps in or onto, or otherwise etches into portion 52*b* when lock 70 rigidly attaches to mechanism 35*b* when the desired height of the drain opening is obtained.

Figure 11B:
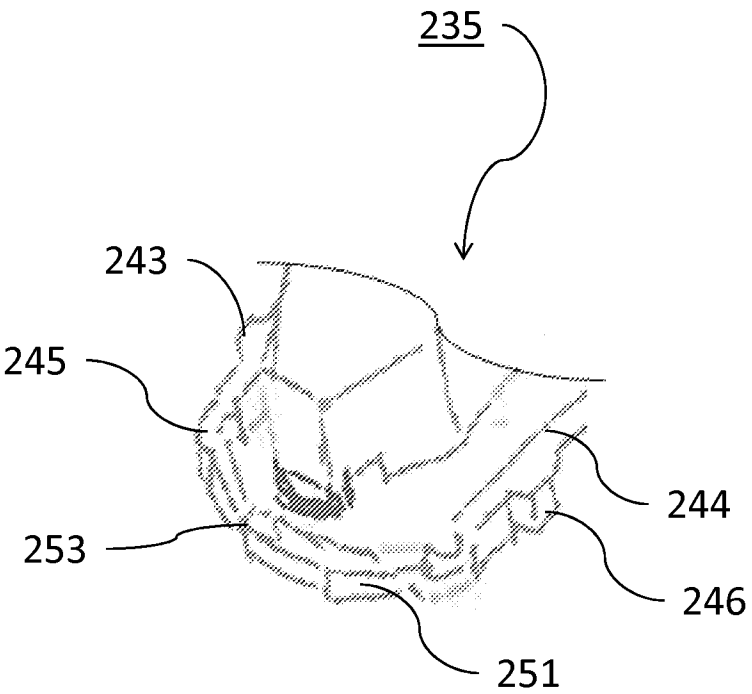
FIGS. 11A and 11B depict perspective views of another lock mechanism between freely positionable and fixed states.
Figure 11A:
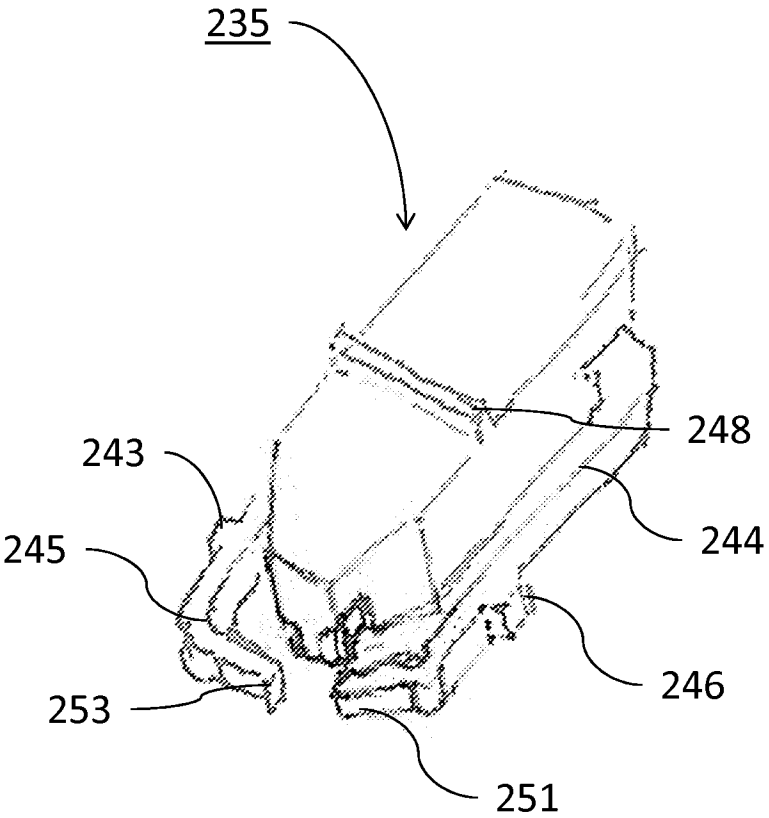

Optionally, FIGS. 11A and 11B depict another slightly modified lock mechanism 235 wherein after being positioned on corresponding receiver 238 (similar to previously described receivers), mechanism 235 is then locked in place by pushing or otherwise applying a push force substantially parallel to window 25 to distal ends 253 and 251 of corresponding coupling portions 244 and 245 as explained herein. FIG. 11A depicts mechanism 235 in a freely positionable state when coupled to receiver 238 and FIG. 11B depicts a closed-up perspective of mechanism 235 when in a fixed state when mechanism 235 is no longer freely positionable when received by receiver 238.

As explained, mechanism 235 comprises coupling portions 244 and 245 similar to previously described portion 44 except for they each comprise coupling surfaces, 251 and 253 respectively. Each of surfaces 251 and 253 are configured to be received by receiver and wrap around the lower portion of mechanism 235 and wherein each of portions 244 and 245 each are relatively flexible and comprise a bias force. In practice, when either of portions 244 and 245 are moved or otherwise caused to flex outwardly away from mechanism 235, they naturally tend to move to a pre-flex position closer to mechanism 235. Surfaces 251 and 253 are configured so that when a pushing force as described is applied to either or both, they rotate, pivot, or otherwise are caused to move towards each other until operatively coupling. Once surfaces 251 and 253 are coupled together, mechanism 235 is not longer freely movably along corresponding receiver 238 such that the size of the drain opening is fixed as required. Mechanism 235 therefore is locked or fixed in place by simply pushing surfaces 251 and/or 253 as described.

The embodiments described herein are merely exemplary and that different shapes and designs may be used. Many alterations and modifications may be made by those having ordinary skill in the art without departing from the spirit and scope of the embodiments disclosed and described herein. Therefore, it is understood that the illustrated and described embodiments have been set forth only for the purposes of examples and that they are not to be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A flush valve system, comprising:

a reservoir comprising a drain opening for egress of liquids disposed in the reservoir into a surrounding toilet tank;

a lock mechanism movably received by the reservoir, wherein the lock mechanism is translatable between one or more fixed positions on the reservoir, and wherein translating the lock mechanism into the reservoir at increasing depths causes a size of the drain opening to be reduced;

a receiver coupled to the reservoir adjacent to the drain opening, wherein the receiver on the reservoir movably receives the lock mechanism, wherein the lock mechanism further comprises:

one or more bias arms that extend longitudinally along one or more edges of the lock mechanism, each arm comprising an inwardly or outwardly facing projection, wherein one of the bias arms comprises a locking tab;

a detent arm substantially parallel to one of the bias arms to receive the locking tab;

wherein the receiver further comprises one or more grooves associated with the one or more bias arms to slidably receive the projections of the bias arms between the one or more fixed positions; and wherein the lock mechanism is locked in one of the fixed positions when the detent arm receives the locking tab.

2. The system according to claim 1, wherein the one or more grooves comprises one or more notches or teeth to receive the projections of the bias arms of the lock mechanism.

3. The system according to claim 2, wherein a beveled edge is positioned on each projection causing the associated bias arm to flex inwardly or outwardly as the beveled edge slides over associated notches or teeth.

4. The system according to claim 2, further comprising a reinforcement lock with a plurality of locking arms received by the lock mechanism to maintain the lock mechanism in the one or more fixed positions, wherein the locking arms are inserted between the bias arms of the lock mechanism to provide a coupling between the reinforcement lock and the reservoir.

5. The system according to claim 4, wherein the reinforcement lock comprises a locking member that extends into the lock mechanism when the locking arms are inserted between the bias arms to fix the lock mechanism in one of the fixed positions.

6. The system according to claim 2, wherein the detent arm further comprises a tab receiving surface, wherein the detent arm is flexed until the tab receiving surface is coupled to the locking tab.

7. The system according to claim 2, wherein each bias arm and the detent arm are flexible and wherein when flexed, return to their pre-flexed position.

8. The system according to claim 1, wherein the drain opening is approximately 0.15 inches, 0.3 inches, 0.35 inches or less than or equal to 0.6 inches.

9. A method of adjusting a drain opening in a reservoir of a flush valve system in a toilet tank, comprising:

slidably inserting a lock mechanism into a receiver coupled to the reservoir, wherein the drain opening governs egress of liquids disposed in the reservoir into the surrounding tank;

translating the lock mechanism between one or more fixed positions on the receiver by slidably inserting one or more bias arms of the lock mechanism into one or more grooves of the receiver, and wherein translating the lock mechanism at increasing depths into the receiver causes a size of the drain opening of the reservoir to be adjusted;

fixing the locking mechanism in one of the one or more fixed positions by coupling a detent arm of the lock mechanism with one of the bias arms.

10. The method according to claim 9, wherein the one or more bias arms comprise projections facing inwardly or outwardly relative to the receiver and are received by the receiver.

11. The method according to claim 9, wherein the one or more grooves comprises one or more notches or teeth to receive the projections of the bias arms of the lock mechanism, the method further comprising:

positioning the lock mechanism in one of the one or more fixed positions by coupling each projection with an associated notch or tooth.

12. The method according to claim 10, further comprising:

flexing the one or more bias arms outwardly or inwardly causing the projection to couple with an associated notch or tooth.

13. The method according to claim 11, further comprising:

reinforcing the lock mechanism in the one or more fixed positions by removably attaching a reinforcement lock onto the lock mechanism; and slidably inserting arms of the reinforcement lock between the bias arms of the lock mechanism to removably couple the reinforcement lock to the lock mechanism and the receiver.

14. The method according to claim 9, wherein each bias arm and the detent arm are flexible and wherein when flexed, return to their pre-flexed position.

* * * * *